US011692357B2

(12) United States Patent
Colyn

(10) Patent No.: US 11,692,357 B2
(45) **Date of Patent: *Jul. 4, 2023**

(54) SIDING PANEL WITH IMPROVED LOCKING MECHANISM AND METHOD OF MANUFACTURE

(71) Applicant: CertainTeed LLC, Malvern, PA (US)

(72) Inventor: Christopher Michael Colyn, Grandville, MI (US)

(73) Assignee: CERTAINTEED LLC, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/385,722

(22) Filed: Jul. 26, 2021

(65) Prior Publication Data

US 2022/0042318 A1 Feb. 10, 2022

Related U.S. Application Data

(63) Continuation of application No. 16/231,572, filed on Dec. 23, 2018, now Pat. No. 11,072,930.

(60) Provisional application No. 62/611,231, filed on Dec. 28, 2017.

(51) Int. Cl.
*E04F 13/08* (2006.01)
*E04C 2/296* (2006.01)

(52) U.S. Cl.
CPC ..... *E04F 13/0864* (2013.01); *E04C 2/296* (2013.01); *E04F 13/0825* (2013.01); *E04F 13/0876* (2013.01)

(58) Field of Classification Search
CPC ..... E04F 13/0864; E04F 13/0825; E04F 13/0876; E04C 2/296
See application file for complete search history.

(56) References Cited

U.S. PATENT DOCUMENTS

| | | | |
|---|---|---|---|
| 3,325,952 | A | 6/1967 | Trachtenberg |
| 4,272,576 | A | 6/1981 | Britson |
| 4,930,287 | A | 6/1990 | Volk et al. |
| 5,775,042 | A | 7/1998 | Mowrey |
| 5,878,543 | A | 3/1999 | Mowrey |

(Continued)

OTHER PUBLICATIONS

CertainTeed Corporation, "Monogram(R) Siding" brochure, Jan. 2017.

(Continued)

*Primary Examiner* — Jessie T Fonseca
(74) *Attorney, Agent, or Firm* — McDonnell Boehnen Hulbert & Berghoff LLP

(57) ABSTRACT

One aspect of the disclosure is a siding panel having a front face, a rear face, a top edge, a bottom edge, a first side, and a second side, the top edge being folded over to create two layers of material. The siding panel further includes a first locking mechanism disposed on the front face adjacent the top edge configured to interlock with a second locking mechanism of a second siding panel, the first locking mechanism having a generally S-shaped portion. The siding panel also includes a second locking mechanism disposed on the rear face of the siding panel having a generally U-shaped portion including a curved section, and the second locking mechanism being configured to interlock with a first locking mechanism of a third siding panel. The first locking mechanism and the second locking mechanism facilitate both locking and unlocking of the siding panel from the third siding panel.

18 Claims, 8 Drawing Sheets

(56) References Cited

U.S. PATENT DOCUMENTS

| | | | |
|---|---|---|---|
| 6,065,260 | A | 5/2000 | Dickey et al. |
| 6,170,215 | B1 | 1/2001 | Nasi |
| 6,341,463 | B1 | 1/2002 | Dickey et al. |
| 6,363,676 | B1 | 4/2002 | Martion, III |
| 6,370,832 | B1 | 4/2002 | McGarry |
| 7,685,787 | B1 | 3/2010 | Mollinger et al. |
| 8,381,472 | B1 | 2/2013 | Fleenor |
| 2007/0107356 | A1 | 5/2007 | Steffes |

OTHER PUBLICATIONS

CertainTeed Corporation, "Encore(TM) Siding" brochure, Sep. 2017.
CertainTeed Corporation, "Great Looks and Affordability" downloaded Nov. 2017.
CertainTeed Corporation, "Styles" downloaded Nov. 2017.

SIDING PANEL WITH IMPROVED LOCKING MECHANISM AND METHOD OF MANUFACTURE

CROSS-REFERENCE TO RELATED APPLICATIONS

This application is a continuation of U.S. patent application Ser. No. 16/231,572, filed Dec. 23, 2018, which claims the benefit of priority of U.S. Provisional Patent Application No. 62/611,231, filed Dec. 28, 2017, each of which is hereby incorporated herein by reference in its entirety.

BACKGROUND OF THE DISCLOSURE

1. Field of the Disclosure

The present disclosure relates generally to siding and siding installation. The present disclosure relates more particularly to siding panel locking mechanisms.

2. Technical Background

Siding products can simulate traditional materials such as wooden clapboards, cedar shakes and the like. Traditional wood siding materials are generally installed in overlapped single tiers or courses. Each wood clapboard course typically includes a row of horizontally or vertically elongated planks (clapboards), butted end to end. Except at the extreme top and bottom, each row is overlapped at its top edge by a next higher course, and in turn laps over a next lower course, to the edges of the sided area.

Such siding panels have connectors formed along the lengths of the edges. In use, the siding panels are arranged in horizontal or vertical interlocking tiers. In general, siding panels include a first lock that is configured to interlock with a second lock of another panel. A nailing hem comprising a series of slots for receiving nails to attach the panel to an underlying structure is generally provided near one of the locks of each panel.

In many cases, once two siding panels are locked together, they can only be separated by use of a special tool, such as a zip tool. Thus, if the panels need to be uninstalled for any reason, removal may be difficult, and in some cases may cause inadvertent damage to a panel.

Accordingly, there is a need for an improved siding panel locking mechanism that facilitates insertion and removal of the panels.

SUMMARY OF THE DISCLOSURE

One aspect of the disclosure is a siding panel comprising:

a siding panel having a front face, a rear face, a top edge, a bottom edge, a first side, and a second side, the top edge being folded over to create two layers of material;

a first locking mechanism disposed on the front face adjacent the top edge configured to interlock with a second locking mechanism of a second siding panel, the first locking mechanism having a generally S-shaped portion; and a second locking mechanism disposed on the rear face of the siding panel, the second locking mechanism having a generally U-shaped portion including a curved section, and the second locking mechanism being configured to interlock with a first locking mechanism of a third siding panel;

wherein the first locking mechanism and the second locking mechanism facilitate both locking and unlocking of the siding panel from the second siding panel and the third siding panel.

In certain embodiments, the first locking mechanism further includes a first substantially flat portion, a second curved channel portion, a third curved portion, and a fourth portion having an outwardly extending lip.

In certain embodiments, the second locking mechanism includes an upwardly extending portion including the curved section, wherein the upwardly extending portion is configured to interlock with a second curved channel portion of the first locking mechanism of the third siding panel.

Another aspect of the disclosure is a siding panel comprising:

a siding panel having a front face, a rear face, a top edge, a bottom edge, a first side, and a second side, the top edge being formed as a folded nail hem;

a first locking mechanism disposed on the front face adjacent the top edge configured to interlock with a second locking mechanism of a second siding panel, the first locking mechanism including a folded nail hem, a second curved portion, a third curved portion, and an outwardly protruding lip; and a second locking mechanism disposed on the rear face of the siding panel, the second locking mechanism including the bottom edge of the siding panel and an upwardly extending portion, the upwardly extending portion having a first curved section;

wherein the upwardly extending portion of the second locking mechanism is configured to engage with a second channel portion of a first locking mechanism of a third siding panel.

Another aspect of the disclosure is a method for installing siding to a siding accessory using an installation aid as described herein. The method includes:

extruding a flat sheet through a series of dies;

forming a first locking mechanism at one edge comprising a first substantially flat portion, a second curved channel portion, a third curved portion, and a fourth portion having an outwardly extending lip;

forming a second locking mechanism at a second edge comprising an upwardly extending portion including a curved section, wherein the upwardly extending portion is configured to interlock with a second curved channel portion of the first locking mechanism of a second siding panel; and flash curing the siding panel.

Another aspect of the disclosure is a siding system comprising first, second, and third siding panels as described herein, disposed on an exterior face of a building, with the first locking mechanism of the first siding panel engaged with the second locking mechanism of the second siding panel, and the second locking mechanism of the first siding panel engaged with the first locking mechanism of the third siding panel. The engagements can be through any mechanism as described herein. The siding panels can be substantially identical to one another (e.g., especially with respect to the first locking mechanism and the second locking mechanism).

Another aspect of the disclosure is a method for installing a siding system. The method includes providing first, second and third siding panels as described herein. The siding panels can be substantially identical to one another (e.g., especially with respect to the first locking mechanism and the second locking mechanism). The method includes disposing the first, second and third siding panels on an exterior face of a building, and engaging the first locking mechanism of the first siding panel with the second locking mechanism of the second siding panel, and engaging the second locking mechanism of the first siding panel with the first locking mechanism of the third siding panel. The disposing and engaging can be performed in any convenient order. For example, the method can be performed by disposing the third panel on the building, then disposing the first panel on the building while engaging the second locking mechanism of the first siding panel with the first locking mechanism of the third siding panel; then disposing the second panel on the building while engaging the first locking mechanism of the first siding panel with the second locking mechanism of the first siding panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

The present inventor has noted disadvantages of conventional methods of installation of siding panels. In one example, a siding panel has a locking feature which secures two adjoining siding panels together. Once the locking feature is engaged, the siding panels are secured together tightly, and can only be removed using a special tool. The present inventor has noted that in many instances it is desirable to be able to easily disengage the panels during installation or for removal.

Accordingly, one aspect of the disclosure is a siding panel having an improved siding panel locking mechanism. The siding panel is produced having enhanced locking features that facilitate the locking and unlocking of the siding panel during installation and/or for removal. Additionally, the siding panel can be manufactured as an extruded sheet using a plurality of dies as opposed to being injection molded, which allows for minimal material usage and cost savings.

Figure 1A:
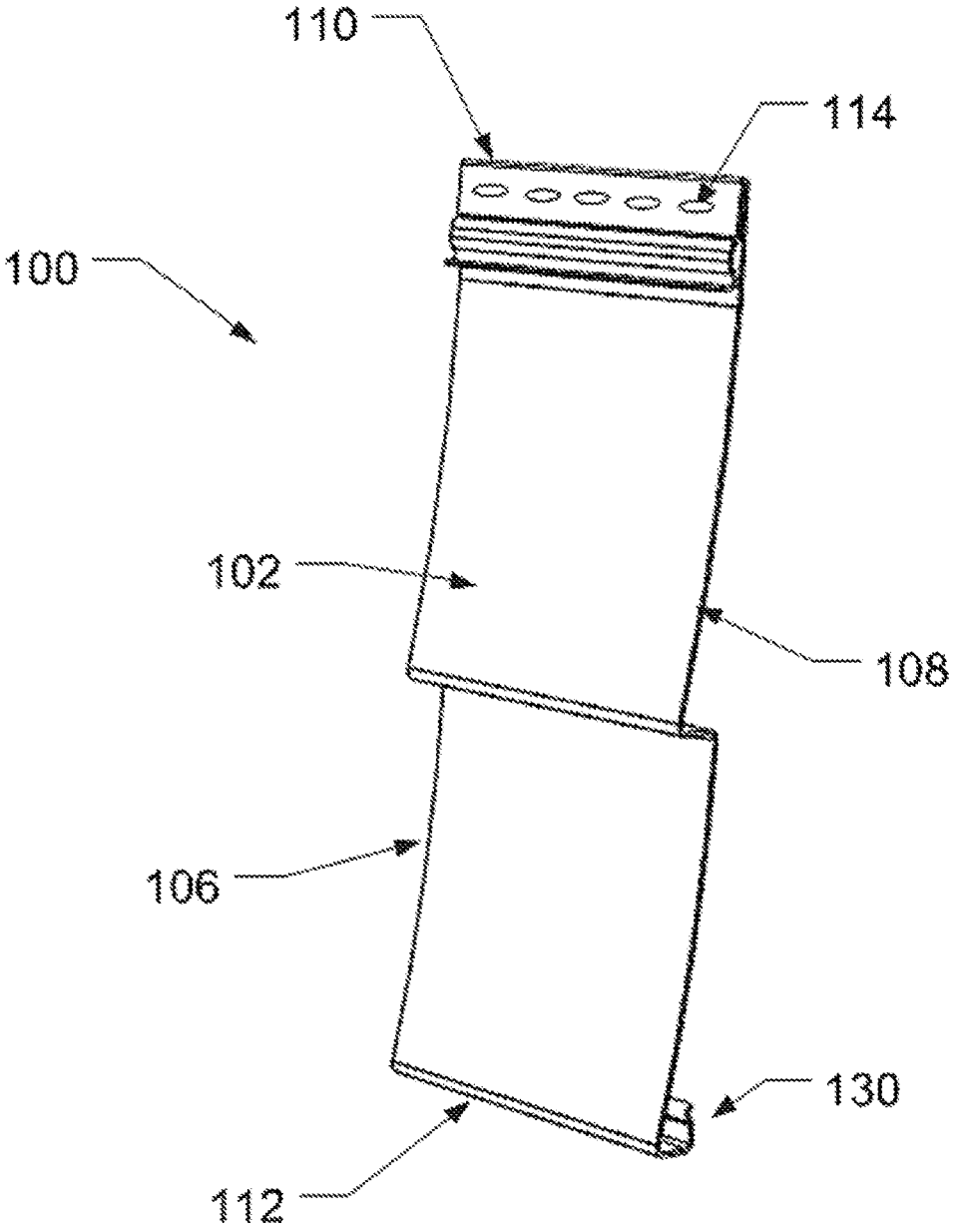
FIG. 1A is a schematic perspective view of a siding panel according to one embodiment of the disclosure.
Figure 1B:
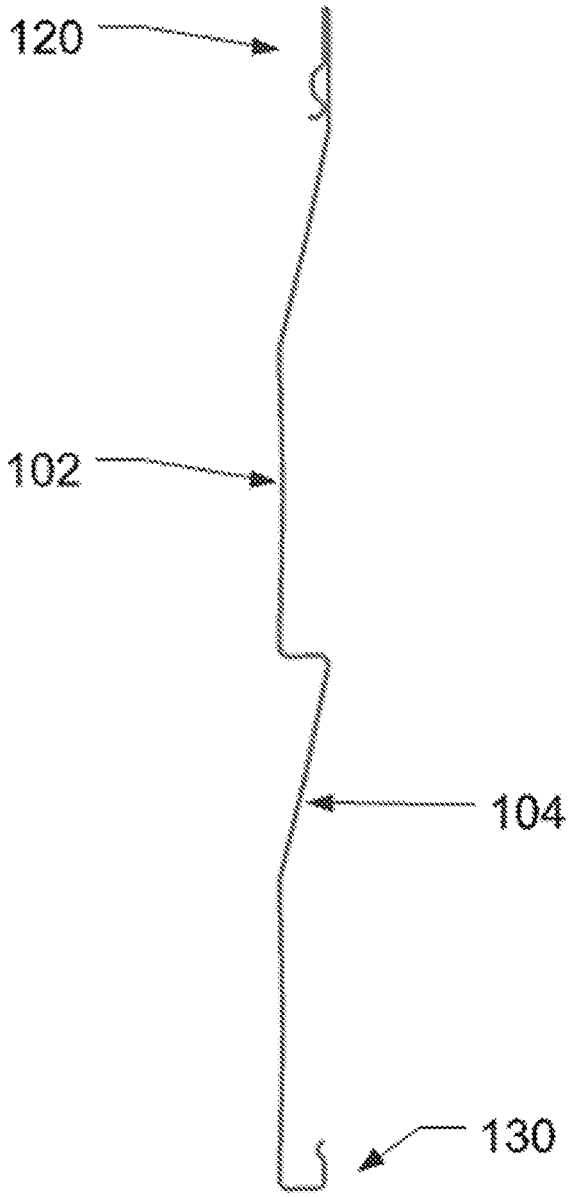
FIG. 1B is a schematic side view of the siding panel of FIG. 1A.

One embodiment of such a siding panel is described with respect to FIGS. 1-5 below. FIGS. 1A-1B show an example siding panel 100 according to an embodiment of the disclosure. The siding panel 100 may comprise a front face 102 and a rear face 104 (shown in FIG. 1B). The siding panel also includes a first end 106, and a second end 108, the first end being opposite the second end.

The siding panel 100 further includes a top edge 110 and a bottom edge 112 being opposite the top edge. As shown in FIGS. 1A-1B, the top edge 110 is folded over to create two layers of material at the top edge. In some embodiments, the top edge 110 is formed as a folded nail hem. The nail hem includes one or more elongated nail slots 114 to receive a fastener such as a siding nail or staple. The folded or rolled over nail hem enhances wind resistance and performance, and also enhances rigidity of the panel, which allows for a stiffer, straighter overall siding panel. As shown, the bottom edge 112 is formed having a rounded or curved profile, allowing for a smooth transition for the mating pieces to lock and unlock. It should be understood that in alternate embodiments may have differently shaped profiles.

The siding panel 100 also includes a first locking mechanism 120 located near the top edge 110, which may comprise a generally S-shaped portion having a plurality of undulations, made up of a series of grooves and protrusions, which extend along the entire front face 102 or a portion of the front face of the siding panel 100. The first locking mechanism 120 is configured to interlock with a second locking mechanism of a second adjacent siding panel, as described below. The interlocking connection facilitates the locking and unlocking of the siding panels during installation and removal. It should be understood that in a vertical siding panel, the first locking mechanism would be located on or near a side edge of the panel.

The siding panel 100 further includes a second locking mechanism 130 located near the bottom edge 112, which is configured to interlock with a first locking mechanism of another adjacent, or third, siding panel, as described below. The second locking mechanism 130 is configured as a generally U-shaped portion which includes the bottom edge 112 of the panel 100, as well as an upwardly extending portion 132.

Figure 2A:
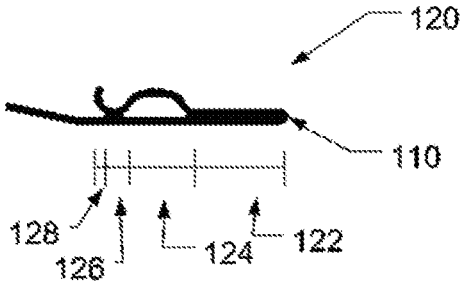
FIG. 2A is a schematic side view of a first locking mechanism according to an embodiment of the disclosure.

Referring now to FIG. 2A, the first locking mechanism 120 may have a generally S-shape, which will be described in terms of four portions. A first portion 122 is substantially flat, and comprises the folded over portion of the nail hem 110. A second portion 124 is located next to the first portion 122, and comprises a channel that extends entirely or partially along the front face 102 of the siding panel 100. The second portion 124 is curved to create a part of the S-shape. A third portion 126 is formed next to the second portion 124. The third portion 126 comprises a curved section configured to rest against or close to the front face 102 of the siding panel 100, and also creates a part of the S-shape. The third portion 126 may also be configured as a flexible spring element which will spring back to its original position. A fourth portion 128 is located adjacent the third portion 126. The fourth portion 128 may be configured as an outwardly extending lip which extends away from the front face 102. It should be understood that in certain embodiments as otherwise described herein, the first locking mechanism 120 may include additional or less portions with varying shapes. In certain embodiments as otherwise disclosed herein, the three sections, 122, 124, and 126 can act together as a spring, or portions of sections 122 and 124, and may act together as a spring.

Figure 2B:
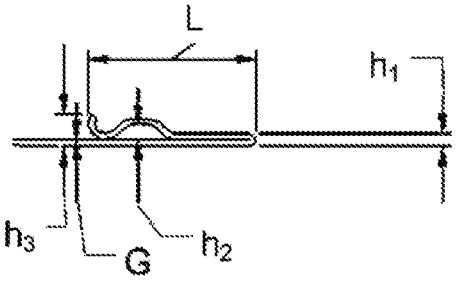
FIG. 2B is a schematic side view of the first locking mechanism showing dimensions.

In certain embodiments as otherwise disclosed herein, the first locking mechanism 120 may be formed with specific dimensions as described herein with reference to FIG. 2B. For example, in some embodiments, the overall length L of the first locking mechanism 120 (comprising sections 122-128) may be in the range of about 0.250 in. to about 3.500 in. In some embodiments, the height $h_1$ of the first portion 122 may be in the range of about 0.066 in. to about 0.170 in, for instance. In some embodiments, the height $h_2$ of the second portion 124 may be in the range of about 0.08 in. to about 0.250 in. In some embodiments, the gap G between the third portion 126 and the front face 102 of the panel may be in the range of about 0 in. (touching the front face) to about 0.08 in, for example. In some embodiments, the height $h_3$ of the fourth portion 128 may be in the range of about 0.125 in. to about 0.375 in, for instance. The S-shape allows for a wide range of dimensions for a similar functioning lock.

Figure 3A:
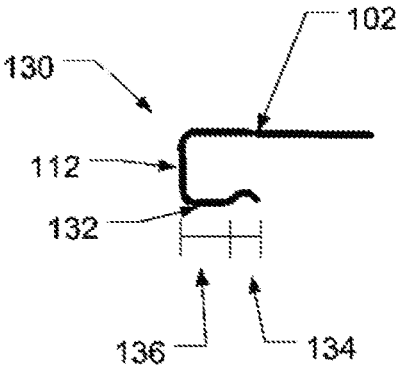
FIG. 3A is a schematic side view of a second locking mechanism according to an embodiment of the disclosure.

Referring to FIG. 3A, the second locking mechanism 130 is configured as a generally U-shaped portion which includes the bottom edge 112 of the panel 100, as well as an upwardly extending portion 132. The upwardly extending portion 132 includes a first section 134, which is configured as a curved section with an inwardly extending protrusion that extends entirely or partially along the upwardly extending portion 132. The first section 134 is configured to interlock with the second section 124 of a first locking mechanism of an adjacent panel, as described in detail below. The upwardly extending portion 132 further includes a second section 136 which is substantially flat, and adjoins the first section 134 to the bottom edge 112.

Figure 3B:
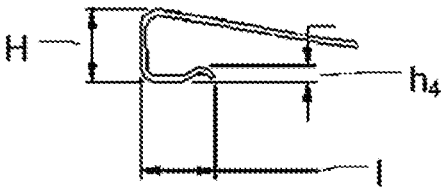
FIG. 3B is a schematic side view of the second locking mechanism showing dimensions.

In certain embodiments as otherwise disclosed herein, the second locking mechanism 130 may be formed with specific dimensions as described herein with reference to FIG. 3B. For example, in some embodiments, the overall height H of the bottom edge 112 may be in the range of about 0.300 in. to about 1.49 in. In some embodiments, the length I of the upwardly extending portion 132 may be in the range of about 0.429 in. to about 0.499 in, for instance. In some embodiments, the height $h_4$ of the first section 134 may be in the range of about 0.07 in. to about 0.13 in., for example.

Figure 4:
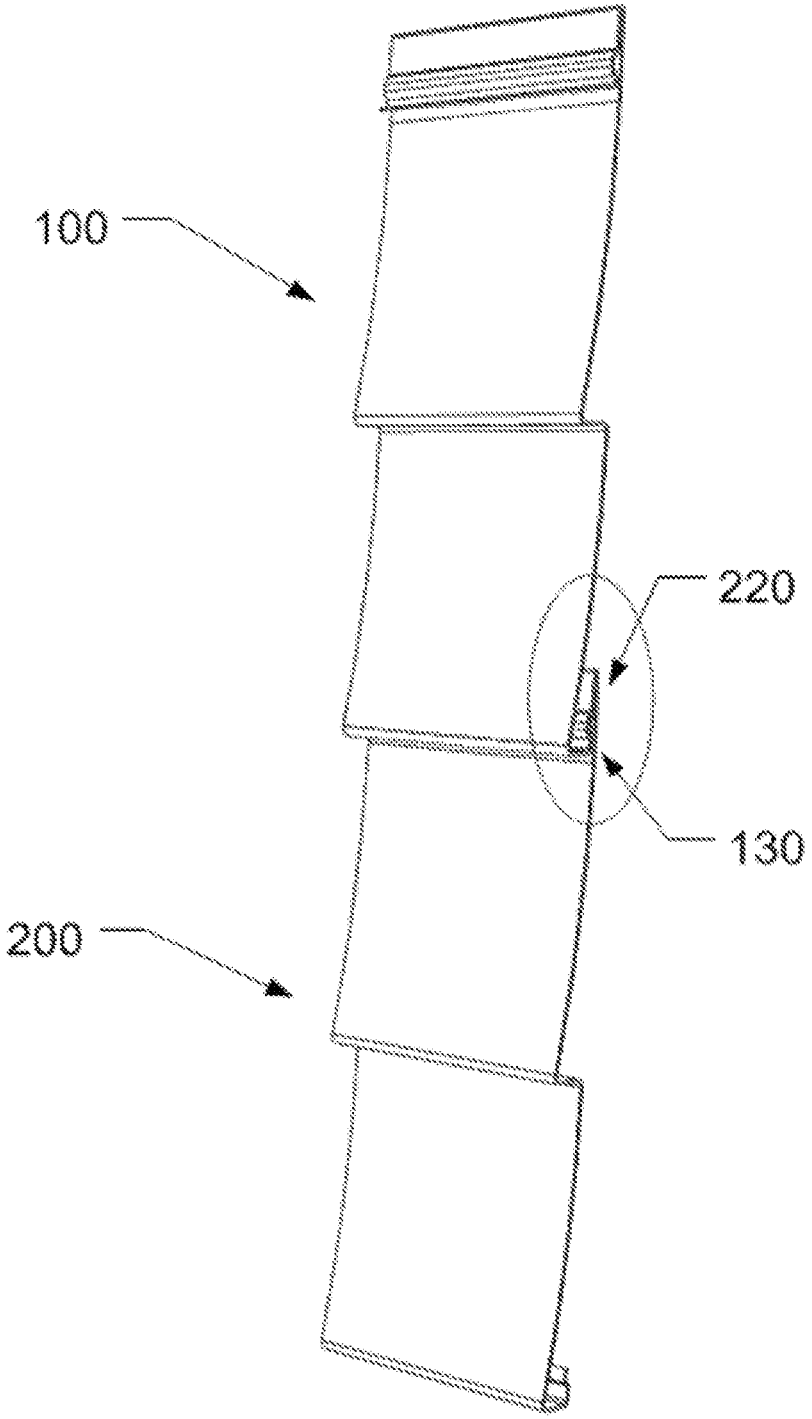
FIG. 4 is a schematic perspective view of two siding panels interlocking according to an embodiment of the disclosure.

In use, a horizontal or vertical siding panel is mounted onto a surface (not shown). In most instances, the surface is a vertical surface such as a wall of a building. The siding panel 100 is placed adjacent to either a starter strip (not shown, for a first horizontal siding panel) or to another siding panel (either below or side by side) which has already been fastened to the surface. As shown in FIG. 4, the siding panel 100 is locked into a second siding panel 200 by inserting the second locking mechanism 130 into the first locking mechanism 220 of an adjacent panel, in this case panel 200, which has already been fastened to the surface. Like parts are designated by like reference numbers (i.e., first locking mechanism 120 of first panel 100 is similar to first locking mechanism 220 of second panel 200).

Figure 5:
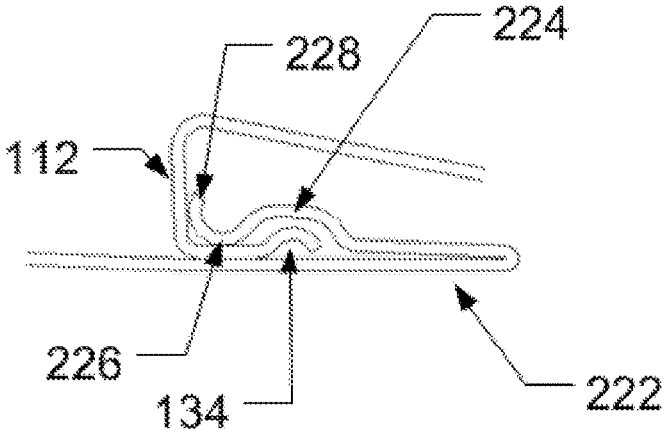
FIG. 5 is a schematic side view of the circled portion of FIG. 4.
Figure 6:
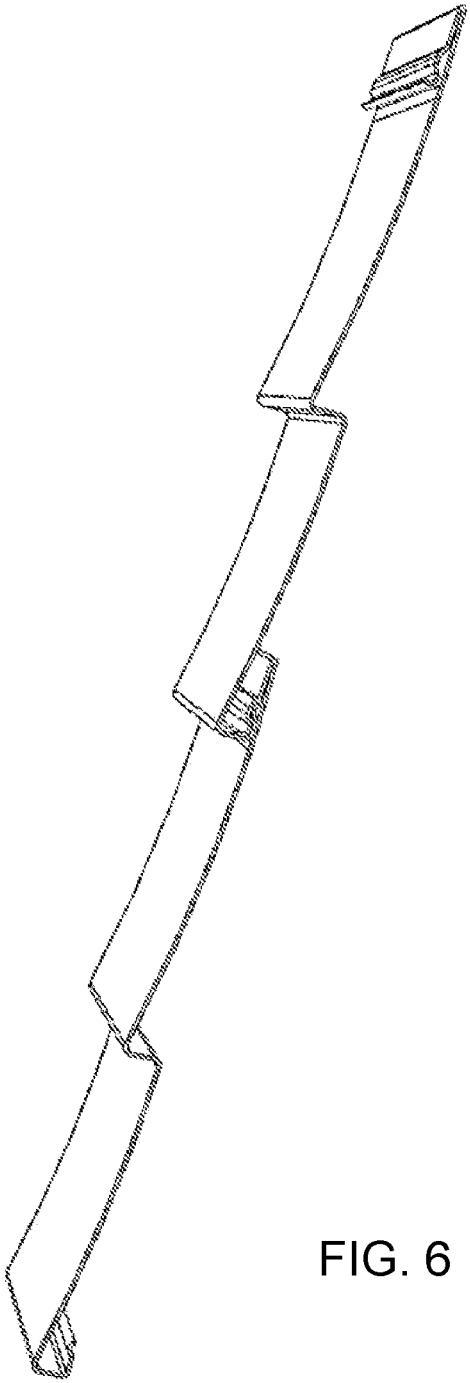
FIG. 6 is a schematic perspective view of two siding panels interlocked by a locking mechanism according to an embodiment of the disclosure.
Figure 7:
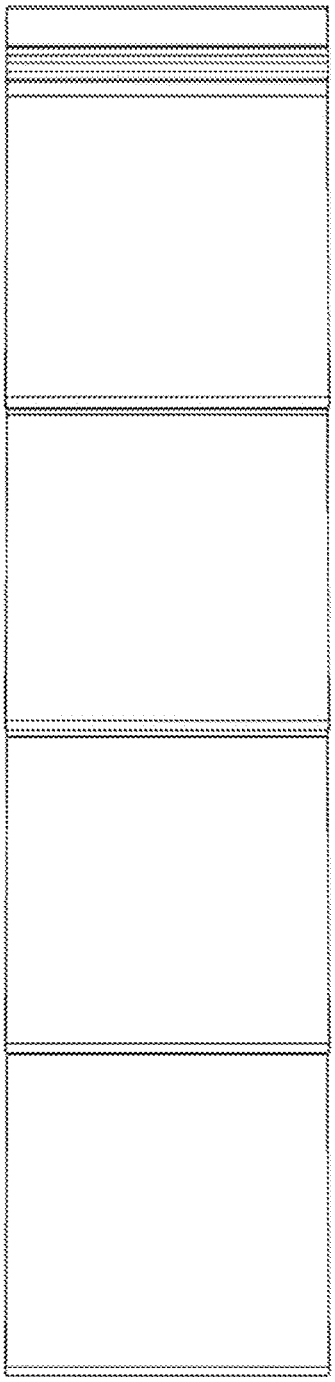
FIG. 7 is a schematic front view of two interlocking siding panels.
Figure 8:
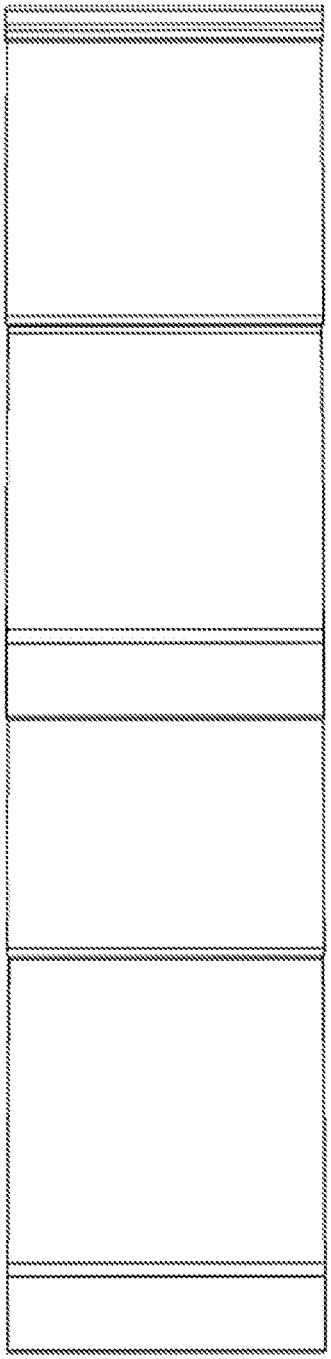
FIG. 8 is a schematic rear view of two interlocking siding panels.
Figure 9:
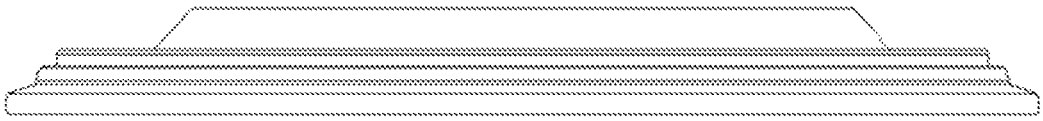
FIG. 9 is a schematic top view of two interlocking siding panels.
Figure 10:
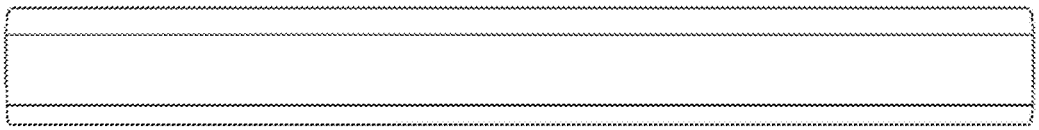
FIG. 10 is a schematic bottom view of two interlocking siding panels.
Figure 11:
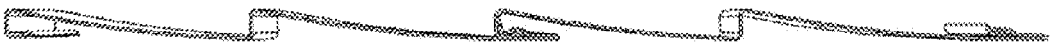
FIG. 11 is a schematic left side view of two interlocking siding panels.
Figure 12:
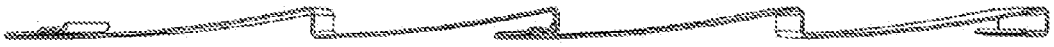
FIG. 12 is a schematic right side view of two interlocking siding panels.

FIG. 5 shows a close-up view of the interlocking of the first locking mechanism 220 of panel 200 and the second locking mechanism 130 of panel 100. When the two panels are brought together, the first section 134 of the second locking mechanism 130 lifts up the first locking mechanism 220, and slides under the third portion 226 into the channel of the second portion 224. The locking mechanisms 220, 130 are pushed together until fully engaged, which is when the outwardly extending lip 228 of the first locking mechanism 220 abuts the surface of the bottom edge 112 of the second locking mechanism 130. Thus, the siding panels 100, 200 are interlocked. The siding panel 100 can then be fastened to the vertical surface by conventional methods.

The above method can then be repeated for the next piece of siding panel, which is placed above the siding panel 100 (or side by side in the case of vertical siding panels), and so forth until the entire surface is covered.

As noted above, the formation and interaction of the first and second locking mechanisms 220, 130 allow for the siding panels to be easily disconnected prior to the fastening of the siding panel to a surface, without the use of a tool, such as a zip tool. An installer may simply pull or force the panels apart manually so the first section 134 of the second locking mechanism 130 slides back under the third portion 226 of the first locking mechanism 220, thereby disengaging the first locking mechanism 220 from the second locking mechanism 130. The locking mechanisms also facilitate insertion of the siding panels since the two initial contact points (of 134 and 228) are shaped like incline planes or ramps that easily open the locking mechanism for installation and removal.

The siding panels of the present disclosure may be manufactured by a post-formed extrusion method, which is easier and more cost efficient than being injection molded or profile extruded. In one example, a flat sheet is heated and extruded through a series of dies. The overall shape of the siding panel, as well as the features of the first and second locking mechanisms, are formed as the sheet moves through the dies. Once the desired shape is created, the siding panel is flash cured to keep the shape.

Notably, the locking mechanism of the present disclosure provides the siding panel with greater wind performance and overall rigidity due to the full rollover of the nail hem, in which a double layer of material is present where the fasteners are applied through the siding to hold it to the mounting surface or wall. Additionally, the shapes of the locking mechanisms are sufficient to allow for thermal expansion of the siding panels, since the space in section 224 is sufficiently large enough to compensate for any misalignment and allow for free movement in comparison to 134.

As the person of ordinary skill in the art will appreciate, the siding panels disclosed herein may be constructed of a single piece or layer of material, such as vinyl, allowing for inexpensive production. In certain embodiments as otherwise disclosed herein, the material may comprise any known siding material, such as PVC, polymer, polypropylene, acrylic, Acrylonitrile Styrene Acrylate (ASA), fiberglass, aluminum, steel, any other plastic, wood, or metal, or combinations thereof.

FIGS. 6-12 show various views of an example siding panel and locking mechanism in accordance with the present disclosure.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A siding panel having a front face, a rear face, a top edge, a bottom edge, a first side, and a second side, the siding panel comprising:

a folded layer of material along the top edge, the folded layer of material forming a folded nail hem at the top edge and a first locking mechanism disposed on the front face, the first locking mechanism including a curved channel portion; and a second locking mechanism disposed at the bottom edge of the siding panel, the second locking mechanism including a U-shaped portion formed by part of the front face, the bottom edge, and an upwardly extending portion opposite the front face, the upwardly extending portion including a curved section, wherein the first locking mechanism of the siding panel is configured to interlock with a second locking mechanism of a second siding panel having the same configuration as the siding panel such that an entire interior surface of the curved channel portion of the first locking mechanism is spaced from the curved section of the upwardly extending portion of the second locking mechanism of the second siding panel.

2. The siding panel of claim 1, wherein the first locking mechanism has a generally S-shaped configuration including another curved portion extending to an outwardly protruding lip.

3. The siding panel of claim 2 wherein the outwardly protruding lip is configured to abut an inner surface of the bottom edge of the second locking mechanism of the second siding panel.

4. The siding panel of claim 1 wherein the upwardly extending portion includes a substantially flat section adjoining the curved section to the bottom edge.

5. The siding panel of claim 1 wherein the folded nail hem includes elongated nail slots.

6. The siding panel of claim 1 wherein a height of the curved channel portion is in a range of about 0.08 in. to about 0.25 in.

7. The siding panel of claim 1 wherein a height of the curved section of the upwardly extending portion is in a range of about 0.07 in. to about 0.13 in.

8. The siding panel of claim 1 wherein a length of the first locking mechanism is in a range of about 0.25 in. to about 3.5 in.

9. The siding panel of claim 1 wherein the siding panel and the second siding panel is configured to be unlocked without the use of a tool before being fastened to a surface.

10. The siding panel of claim 1 wherein the siding panel is manufactured via post-formed extrusion.

11. The siding panel of claim 1 wherein the siding panel includes a polymer material.

12. The siding panel of claim 11 wherein the siding panel is constructed from PVC, polypropylene, acrylic, Acrylonitrile Styrene Acrylate (ASA), fiberglass, or combinations thereof.

13. The siding panel of claim 1 wherein the siding panel includes a metal or wood material.

14. A siding system comprising first and second siding panels disposed on an exterior face of a building, each of the first siding panel and second siding panel having a front face, a rear face, a top edge, a bottom edge, a first side, and a second side, and comprising:

a folded layer of material along the top edge, the folded layer of material forming a folded nail hem at the top edge and a first locking mechanism disposed on the front face, the first locking mechanism including a curved channel portion; and a second locking mechanism disposed at the bottom edge of the siding panel, the second locking mechanism including a U-shaped portion formed by part of the front face, the bottom edge, and an upwardly extending portion opposite the front face, the upwardly extending portion including a curved section, wherein the first locking mechanism of the first siding panel is interlocked with the second locking mechanism of the second siding panel such that an entire interior surface of the curved channel portion of the first locking mechanism of the first siding panel is spaced from the curved section of the upwardly extending portion of the second locking mechanism of the second siding panel.

15. The siding system of claim 14 wherein the folded nail hem of each of the first siding panel and second siding panel includes elongated nail slots.

16. The siding system of claim 15 wherein each of the first siding panel and second siding panel is attached to the exterior face of the building using mechanical fasteners that extend through the respective nail slots.

17. The siding system of claim 14 wherein the first locking mechanism of each of the first siding panel and the second siding panel has a generally S-shaped configuration including another curved portion extending to an outwardly protruding lip.

18. The siding system of claim 17 wherein the outwardly protruding lip of the first locking mechanism of the first siding panel abuts the bottom edge of the second locking mechanism of the second siding panel.

* * * * *